US006894441B2

(12) United States Patent
Chang

(10) Patent No.: US 6,894,441 B2
(45) Date of Patent: May 17, 2005

(54) METHOD AND APPARATUS FOR DETECTING REMAINING LAMP LIFETIME

(75) Inventor: Wei-Chun Chang, Shulin (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/628,948

(22) Filed: Jul. 28, 2003

(65) Prior Publication Data

US 2004/0032225 A1 Feb. 19, 2004

(30) Foreign Application Priority Data

Aug. 9, 2002 (TW) ..... 91117956 A

(51) Int. Cl.[7] ..... G05F 1/00
(52) U.S. Cl. ..... 315/291; 315/307; 315/292
(58) Field of Search ..... 315/291, 307, 315/297, 360, 224, 29.2, 293, 311

(56) References Cited

U.S. PATENT DOCUMENTS 5,668,850 A * 9/1997 Abdel-Malek ..... 378/210
6,157,143 A * 12/2000 Bigio et al. ..... 315/307
6,177,768 B1 * 1/2001 Kamata et al. ..... 315/241 R
2004/0027545 A1 * 2/2004 Yokoyama et al. ..... 353/52

* cited by examiner

*Primary Examiner*—Tuyet Thi Vo
(74) *Attorney, Agent, or Firm*—Ladas & Parry LLP

(57) ABSTRACT

A method for detecting the remaining lifetime of light source lamp. In the method of the present invention, a lamp voltage across two lamp electrodes of the light source lamp is measured. The measured voltage is then converted to a digital value. Next, the digital value is compared with a relational table to calculate the remaining lifetime of the lamp.

15 Claims, 3 Drawing Sheets

METHOD AND APPARATUS FOR DETECTING REMAINING LAMP LIFETIME

BACKGROUND OF THE INVENTION

1. Field of the Invention

The present invention relates to a projector, and in particular to a projector capable of detecting the remaining lifetime of its light source lamp, as well as the detecting method thereof.

2. Description of the Related Art

Conventionally, projectors optically process a light beam emitted from a light source to form an optical image, while enlarging and projecting the optical image through a projection lens. Such projectors are widely used for multimedia presentations. Typically, light source lamps, such as metal halide lamps, xenon lamps and the like, are used in projectors as the light sources.

While such a light source lamp can emit relatively stable light for several hours after it is put into use, lamp use beyond that limit may exceed the usable life of the lamp, wherein luminance is considerably reduced. The lamp may burn out and potential danger may be produced due to gradually increasing lamp voltage caused by exceeding the effective lifetime of the lamp.

For this reason, conventional projectors accumulate the time used of the lamp therein by a timer, and advise replacement with a new lamp when the accumulated lifetime of the lamp exceeds a predetermined time. However, different tolerances still exist between lamps, even within the same type. Namely, in the same type of lamps, some lamps burn out while others may be used for a short time even when exceeding the predetermined usable time. As well, the usable time of lamps operated at high brightness is less than of those operated at low brightness, thus, waste occurs if the lamp is replaced with a new one in accordance with only the estimated lifetime of the lamp.

SUMMARY OF THE INVENTION

Accordingly, an object of the invention is to determine the remaining lifetime of the light source lamp more accurately according to the lamp voltage across the lamp electrodes.

Another object of the invention is to advise replacement of the old light source lamp at a suitable time, thereby avoiding resource wastage and the potential danger caused by gradually increasing lamp voltage.

According to the above mentioned objects, the present invention provides a method for detecting the remaining lifetime of a light source lamp.

In the method of the present invention, a lamp voltage across two electrodes of the light source lamp is measured. The measured voltage is then converted to a digital value. Next, the digital value is compared with a relational table to calculate the remaining lifetime for the lamp.

According to the above mentioned objects, the invention also provides a projector capable of detecting remaining lamp life of the light source lamp therein.

In the projector of the present invention, an image projection device has a light source lamp with a pair of lamp electrodes. A detection unit detects the voltage across the lamp electrodes of the lamp. An analog-to-digital converter converts the voltage into a digital value. A control unit compares the digital value with a relational table to calculate the remaining lifetime of the lamp.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

In conventional projectors, there is a common characteristic between light source lamps produced by OSRAM, PHILIP, USHIO and the like. Namely, brightness of the lamps decreases as the lifetime increases, such that the lamp voltage across the lamp electrodes of the lamp is increased as lifetime increases, to maintain constant brightness. Therefore, the present invention determines the remaining lifetime of the lamp in the projector based on this characteristic to advise replacement with a new lamp.

Figure 1:
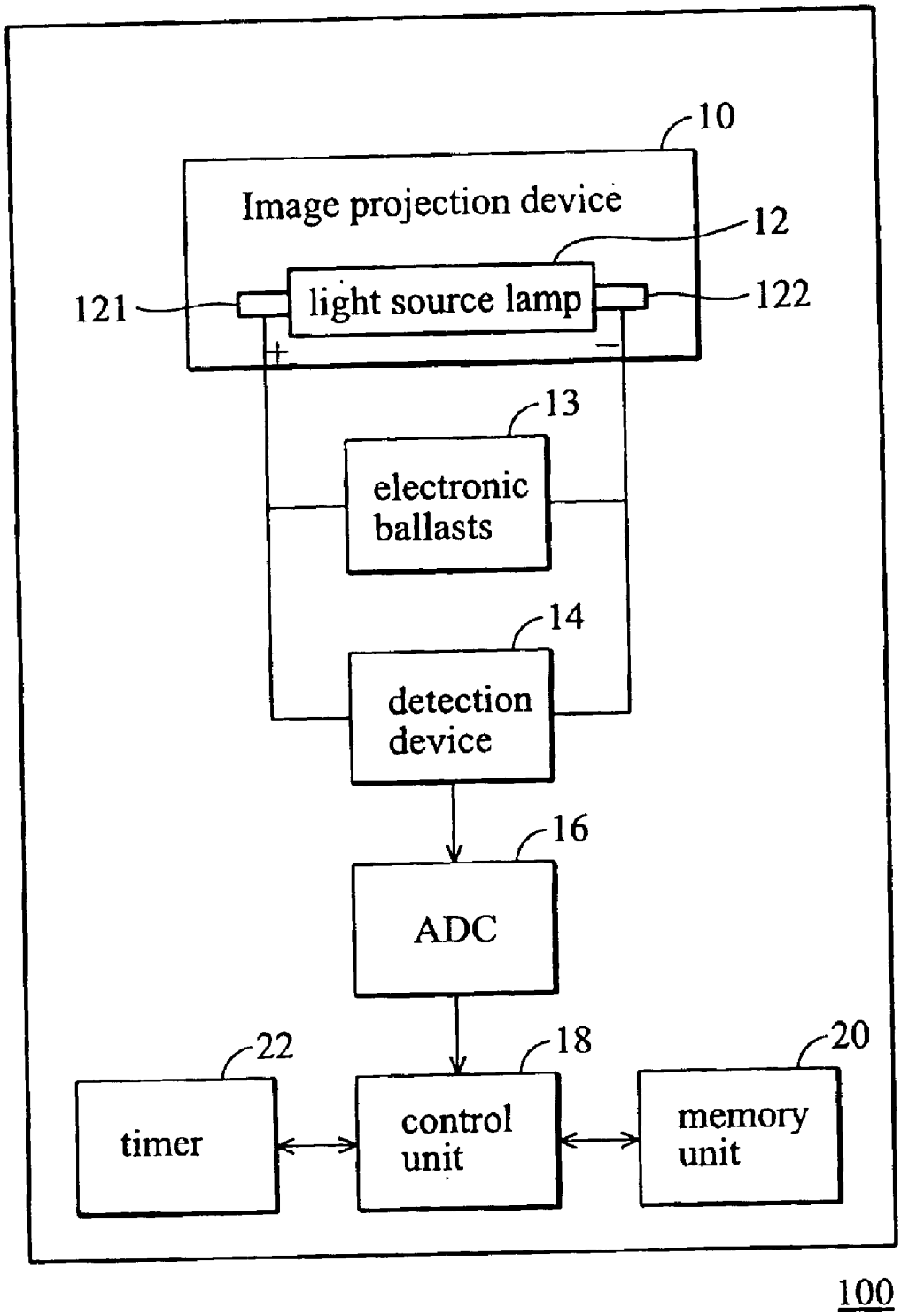
FIG. 1 is a diagram of the projector according to the present invention.

FIG. 1 shows a projector 100 capable of detecting the remaining lifetime of a light source lamp 12 therein according to the present invention. The projector 100 has an image projection device 10, a detection unit 14, an analog-to-digital converter 16 and a control unit 18. The image projection device 10 has a lamp 12 with a pair of lamp electrodes 121 and 122. The detection unit 14 detects the voltage Va (lamp voltage) across the lamp electrodes 121 and 122 of the lamp 12. The analog-to-digital converter 16 converts the detected voltage into a digital value. The control unit 18 compares the digital value with a relational table to calculate the remaining lifetime of the lamp 12.

Figure 2:
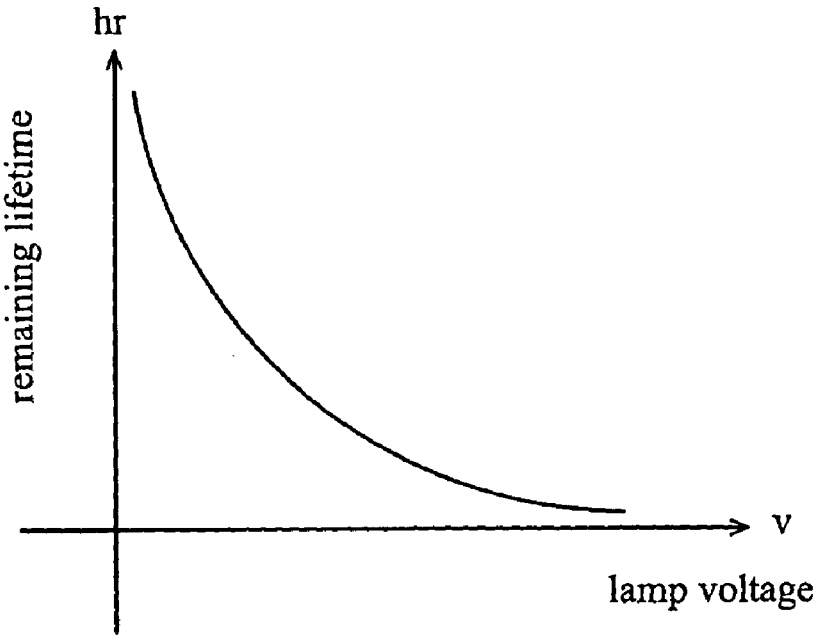
FIG. 2 shows a curve related to the remaining lifetime and the voltage across the lamp electrodes of the light source lamp.

The image projection device 10 optically processes a light beam emitted from the lamp 12 to form an optical image, enlarging and projecting the optical image through a projection lens (not shown). The lamp 12 can be a metal halide lamp, a xenon lamp and the like, capable of emitting relatively stable light for several hundred hours, as many as 900 to 1100 hours. Further, in such light sources as lamp 12, the lamp voltage Va across the lamp electrodes increases with time used thereof to maintain brightness. Namely, the lamp voltage Va across the lamp electrodes 121 and 122 is lower, for example 60~85V, when the lamp is new. As the lifetime of the lamp 12 increases, the lamp voltage Va across the lamp electrodes increases gradually, for example, to about 115~120V, to maintain uniform brightness. FIG. 2 shows a curve of the relationship between the remaining lifetime and the lamp voltage of the lamp. The present invention thus determines the remaining lifetime of the lamp 12 according to this characteristic, and advises replacement accordingly.

The detection device 14, for example, is a voltage detector coupled between the lamp electrodes 121 and 122 of the lamp 12 to detect the lamp voltage Va across the lamp electrodes 121 and 122. Further, the projector 100 also has electronic ballasts 13 to moderate the variation of the current within the lamp 12, and to assist the lamp 12 in start-up. A timer 22 accumulates the time used of the lamp 12. The projector 100 further has a memory for storing the relational table between the lamp voltage Va and the remaining lifetime of the lamp 12, previously.

Analog-to-digital converter (ADC) 16, for example, converts an analog voltage signal or an analog current signal into a digital value for the digital circuit, such as a microprocessor. In the present invention, the analog-to-digital converter 16 converts the detected lamp voltage Va (analog voltage) across the lamp electrodes 121 and 122 into a digital value. The control unit 18, for example, is a microcontroller unit coupled to the analog-to-digital converter 16 and the memory unit 20 to compare the digital value converted from the lamp voltage Va with the relational table, and to calculate the remaining lifetime of the lamp 12.

Figure 3:
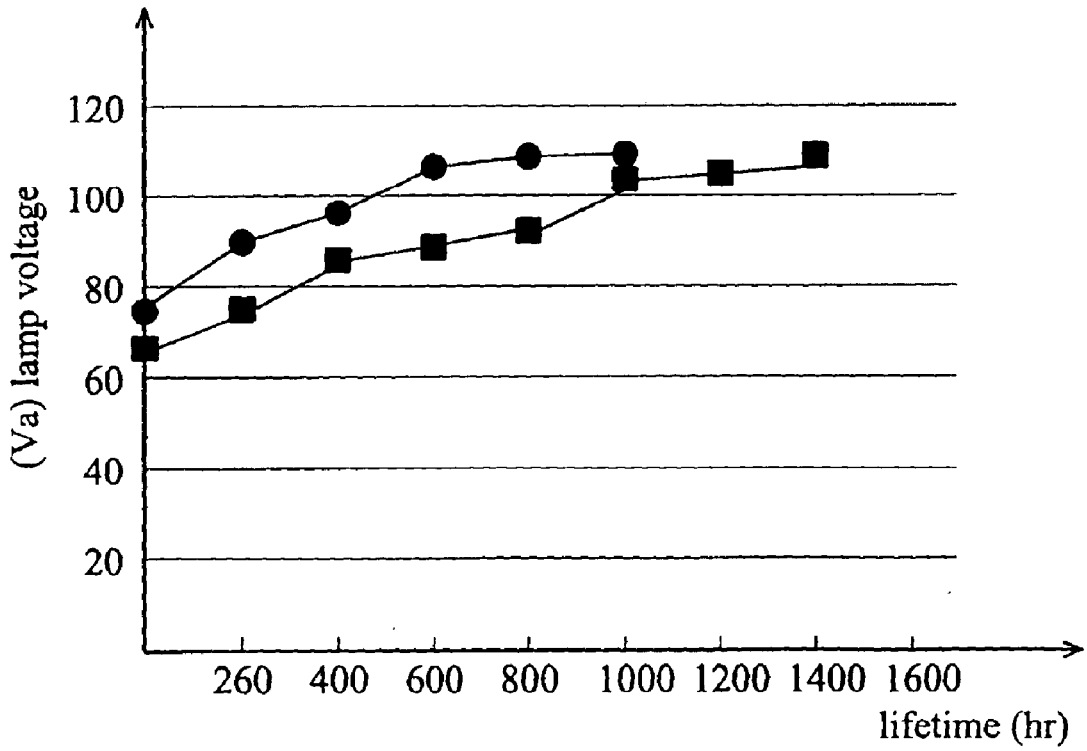
FIG. 3 shows the relationship between the lifetime and the voltage across the lamp electrodes of the light source lamp.

In the example of OSRAM lamps AC 130W, most lamps have lifetime beyond 1000 hours and some better lamps further have lifetime beyond 1500 hours. However, all the lamps burn out when the lamp voltage across the lamp electrodes is about 110V, as shown in FIG. 3.

In this embodiment, the threshold voltage is assumed at 110V. Namely, the lamp 12 should be replaced with a new one when the lamp voltage Va exceeds 110V. If the lamp voltage Va detected by the detection device 14 is 105V and the lamp voltage increases 1V as the lifetime of the lamp increases 3.3 hours, the remaining lifetime of the lamp is then calculated. In this case, the remaining lifetime of the lamp is about 16 hours.

For example, the detector device 14 is usually initialized when the projector 100 is turned on. In addition, the remaining lifetime of the lamp 12 is displayed in the projected image. Furthermore, the control unit 18 outputs a warning signal to advise users to prepare a new lamp for backup when the detected voltage Va reaches or exceeds 110V or the remaining lifetime of the lamp is less than a predetermined time, such as 5 hours.

Alternately, the control unit 18 enables the timer 22 to calculate a predetermined time interval, such as 5~10 minutes, when the detected voltage Va reaches or exceeds 110V, namely, the remaining lifetime of the lamp is used up. After about 5~10 minutes, the projector 100 is then turned off by the control unit 18 to avoid the lamp voltage increasing with time used, and further avoid the potential danger caused by gradually increasing lamp voltage.

Figure 4:
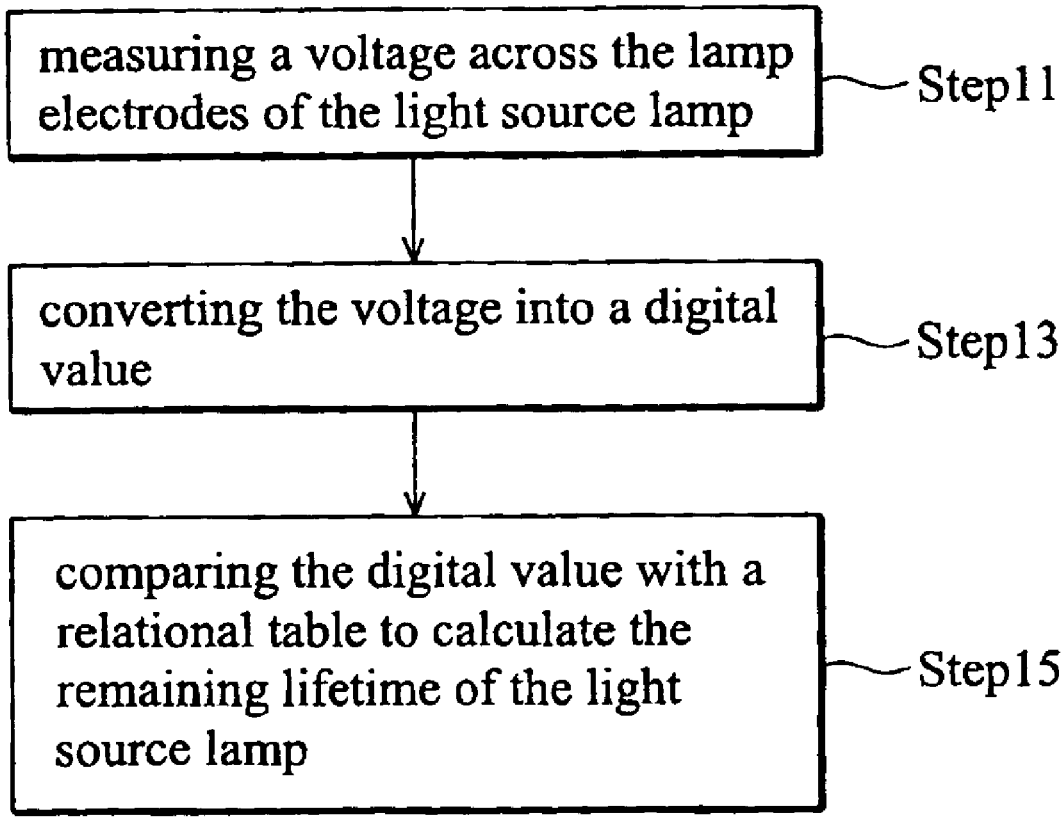
FIG. 4 is a flowchart of the detecting method according to the present invention.

FIG. 4 is a flowchart of the method of detecting the remaining lifetime of the lamp according to the present invention.

In step 11, the detection device 14 detects the lamp voltage Va across the lamp electrodes 121 and 122 of the lamp 12 when the projector 100 is turned on.

In step 13, the detected lamp voltage Va is converted to a digital value by the analog-to-digital converter 16.

In step 15, the remaining lifetime of the lamp 12 is calculated by the control unit 18 according to the digital value and a relational table of the lamp voltage Va across the lamp electrodes and the remaining lifetime of the lamp 12. Further, the remaining lifetime of the lamp 12 calculated by control unit 18 is then shown in the projected image. Furthermore, the control unit 18 outputs a warning signal to advise users to prepare a new lamp for backup when the remaining lifetime is less than a predetermined time, such as 3~5 hours.

Alternately, the control unit 18 checks the time used of the lamp 12 recorded by the timer 22 when the projector 100 is turned on. Steps 11, 13 and 15 are then executed when the lifetime of the lamp exceeds a predetermined time interval, for example 1000 hours.

Thus, the present invention can determine the remaining lifetime of the lamp more accurately according to the lamp voltage across the lamp electrodes, and can advise replacement of the old lamp with a new one at a suitable time thereby avoiding resource wastage and the potential danger caused by gradually increasing lamp voltage.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A projector capable of detecting remaining lifetime of the light source lamp therein, comprising:

an image projection device having a light source lamp with a pair of lamp electrodes;

a detection device for detecting a voltage across the lamp electrodes;

an analog-to-digital converter for converting the voltage to a digital voltage value; and a control unit for comparing the digital voltage value with a relational table to obtain the remaining lifetime of the light source lamp directly, wherein the relational table reflects the relationship between the remaining lifetime and the voltage across the lamp electrodes of the light source lamp.

2. The projector as claimed in claim 1, further comprising a timer for accumulating the time used of the lamp, and the control unit comparing the digital value with the relational table when the time used of the lamp exceeds a first predetermined time.

3. The projector as claimed in claim 1, further comprising a memory unit for storing the relational table.

4. The projector as claimed in claim 1, wherein the control unit further outputs a warning signal when the lifetime of the lamp is less than a predetermined time.

5. The projector as claimed in claim 1, wherein the control unit further outputs a warning signal when digital voltage value exceeds a predetermined value and turns off the projector within a predetermined time interval.

6.The projector as claimed in claim 1, wherein, in the lamp, the voltage across the lamp electrodes increases as time used of the lamp increases.

7. A method of detecting the remaining lifetime of a light source lamp, comprising measuring a voltage across the lamp electrodes of the light source lamp;

converting the voltage to a digital voltage value; and comparing the digital voltage value with a relational table directly to obtain the remaining lifetime of the lamp, wherein the relational table reflects the relationship between the remaining lifetime and the voltages across the lamp electrodes of the lamp.

8. The method as claimed in claim 7, further comprising a step of detecting the time used of the lamp.

9. The method as claimed in claim 7, further comprising a step of displaying the remaining lifetime of the lamp in a projected image.

10. The method as claimed in claim 7, further comprising a step of outputting a warning signal when the remaining lifetime is less than a predetermined time.

11. The method as claimed in claim 7, further comprising a step of turning off a projector including the light source lamp within a predetermined time interval when the detected voltage exceeds a predetermined voltage.

12. A projector capable of detecting remaining lifetime of the light source lamp therein, comprising:

an image projection device having a light source lamp with a pair of lamp electrodes and projecting images;

a detection device for detecting a voltage across the lamp electrodes;

an analog-to-digital converter for converting the detected voltage to a digital voltage value; and a control unit for comparing the digital voltage value with a relational table to calculate the remaining lifetime of the lamp, and turning off the projector within a predetermined time interval when the detected voltage exceeds a predetermined voltage, wherein the relational table reflects the relationship between the remaining lifetime and the voltage across the lamp electrodes of the lamp.

13. The projector as claimed in claim 12, further comprising a memory unit for storing the relational table.

14. The projector as claimed in claim 12, wherein the control unit further outputs a warning signal when the lifetime of the lamp is less than a predetermined time.

15. The projector as claimed in claim 12, wherein the image projection device projects the remaining life of the lamp in the projected images.

* * * * *